US006178597B1

(12) United States Patent
Suzuki et al.

(10) Patent No.: US 6,178,597 B1
(45) **Date of Patent: *Jan. 30, 2001**

(54) OPERATIVE HINGE FOR OPENING/CLOSING BODY

(75) Inventors: Naokazu Suzuki; Isao Nagashima; Akira Sorimachi; Oriya Fujita, all of Kanagawa (JP)

(73) Assignee: Katoh Electrical Machinery Co., Ltd., Kanagawa (JP)

( * ) Notice: Under 35 U.S.C. 154(b), the term of this patent shall be extended for 0 days.

This patent is subject to a terminal disclaimer.

(21) Appl. No.: 09/293,583

(22) Filed: Apr. 16, 1999

(30) Foreign Application Priority Data

Apr. 16, 1998 (JP) ..... 10-106566

(51) Int. Cl.[7] ..... E05D 11/08

(52) U.S. Cl. ..... 16/330; 16/342; 16/303; 16/54; 4/236; 188/268

(58) Field of Search ..... 16/340, 330, 303, 16/337, 342, 54, 50; 4/236, 240, 246.1, 248; 188/268, 236, 290

(56) References Cited

U.S. PATENT DOCUMENTS 4,574,423 * 3/1986 Ito et al. ..... 16/85
4,909,361 * 3/1990 Stark et al. ..... 188/268
5,109,571 * 5/1992 Ohshima et al. ..... 16/330
5,193,228 * 3/1993 Murasawa et al. ..... 4/236
5,542,508 * 8/1996 Van Erden et al. ..... 188/290
5,768,718 * 6/1998 Sorimachi ..... 4/236
5,906,010 * 5/1999 Suzuki ..... 16/342
5,996,132 * 12/1999 Sorimachi ..... 16/303

* cited by examiner

*Primary Examiner*—Chuck Y. Mah
(74) *Attorney, Agent, or Firm*—Notaro & Michalos P.C.

(57) ABSTRACT

An operative hinge for use with an opening/closing body is provided which comprises a hinge case to be installed to a toilet bowl body for operating the opening/closing body; a shaft provided rotatably within the hinge case to support the opening/closing body; a stationary cam fixed within the hinge case and having formed therein a central through-hole through which the rotating shaft is axially penetrated; a cam provided within the hinge case and having formed therein a central through-hole through which the rotating shaft is axially penetrated to be slidable on, and rotatable with, the rotating shaft; and a resilient means for urging the rotatable sliding cam toward the stationary can, the hinge further comprising, to further positively control the rotation or the rotating means, a damping means consisting of a rubber ring fitted on the rotating shaft and interposed between the outer surface of the rotating shaft and the inner wall of the hinge case; and a viscous oil applied between the outer surface of the rubber ring and inner wall of the hinge case; the rubber ring having spiral recesses formed on the outer surface thereof.

9 Claims, 17 Drawing Sheets

OPERATIVE HINGE FOR OPENING/ CLOSING BODY

BACKGROUND OF THE INVENTION

1. Field of the Invention

The present invention relates to an operative hinge, and more particularly to an operative hinge suitable for use with an opening/closing body such as a seat and seat lid of a toilet bowl.

2. Description of the Prior Art

Various types of operative hinges for use with a seat and seat lid of a toilet bowl have been proposed so fax. Typical ones of such hinges include a combination of a shaft to support thereon the toilet seat and lid to be pivotable for opening or closing, with a cam mechanism incorporating a compression spring to act on the shaft, a combination of a rotating shaft and a torsion spring which acts to cancel a torque of the shaft being rotated in a predetermined direction, a combination of a rotating shaft and a rotating hydraulic damper, or a similar combination The combination of a rotating shaft with a cam mechanism incorporating a compression spring to act on the shaft is advantageous in that a matching can be easily be attained between a torque generated when the seat and lid are operated and an angular moment of the seat and lid. For a large rotating torque, however, the entire structure of the operative hinge should be designed larger.

The combination of a rotating with only a torsion spring acting on the shaft has an advantageous in that a small structure can create a large rotating torque. Since it creates a rotating torque which will increase and decrease linearly, however, no easy matching is possible between the rotating torque and an angular moment of the seat and lid which will depict a sine curve, and it is difficult to elaborately fit the movement of the seat and lid as necessary to the rotating torque and also to appropriately control the movement of the seat and lid in each of the operating steps.

Further, the combination of a rotating shaft with only a rotating hydraulic damper is advantageous in that it is difficult to elaborately fit the moment of the seat and lid as necessary to the rotating torque and appropriately control the movement of the seat and lid in each of the operating steps, and that the seat and lid being opened or closed cannot easily be stopped and halted in au intermediate angular position and braked at a predetermined angular position the seat and lid have reached during each of the operating strokes, for example.

SUMMARY OF THE INVENTION

Accordingly, the present invention has an object to overcome the above-mentioned drawbacks of the prior art by providing an operative hinge of a simple structure destined for use with an opening/closing body such as a seat and seat lid of a toilet bowl and adapted to control the rotating moment of the opening/closing body to softly close the latter.

The above object can be achieved by providing an opeative hinge for use with an opening/closing body, including:

a hinge case;

a shaft provided rotatably within the hinge case to support the opening/closing body;

a stationary cam fixed within the hinge case and having formed therein a central through-hole through which the rotating shaft is axially penetrated;

a cam provided within the hinge case and having formed therein a central through-hole through which the rotating shaft is axially penetrated to be slidable on, and rotatable with, the rotating shaft; and a resilient means for urging the rotatable sliding cam toward the stationary cam, the hinge comprising, according to the present invention, to control the rotation or the rotating shaft:

a damping means consisting of:

a rubber ring fitted on the rotating shaft and interposed between the outer surface of the rotating shaft and the inner wall of the hinge case; and a viscous oil applied between the outer surface of the rubber rig and inner wall of the hinge case;

the rubber ring having spiral recesses formed on the outer surface thereof.

The rubber ring included in the present invention may have formed thereon recesses or projections which may have various forms to provide various effects as will further be described layer.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
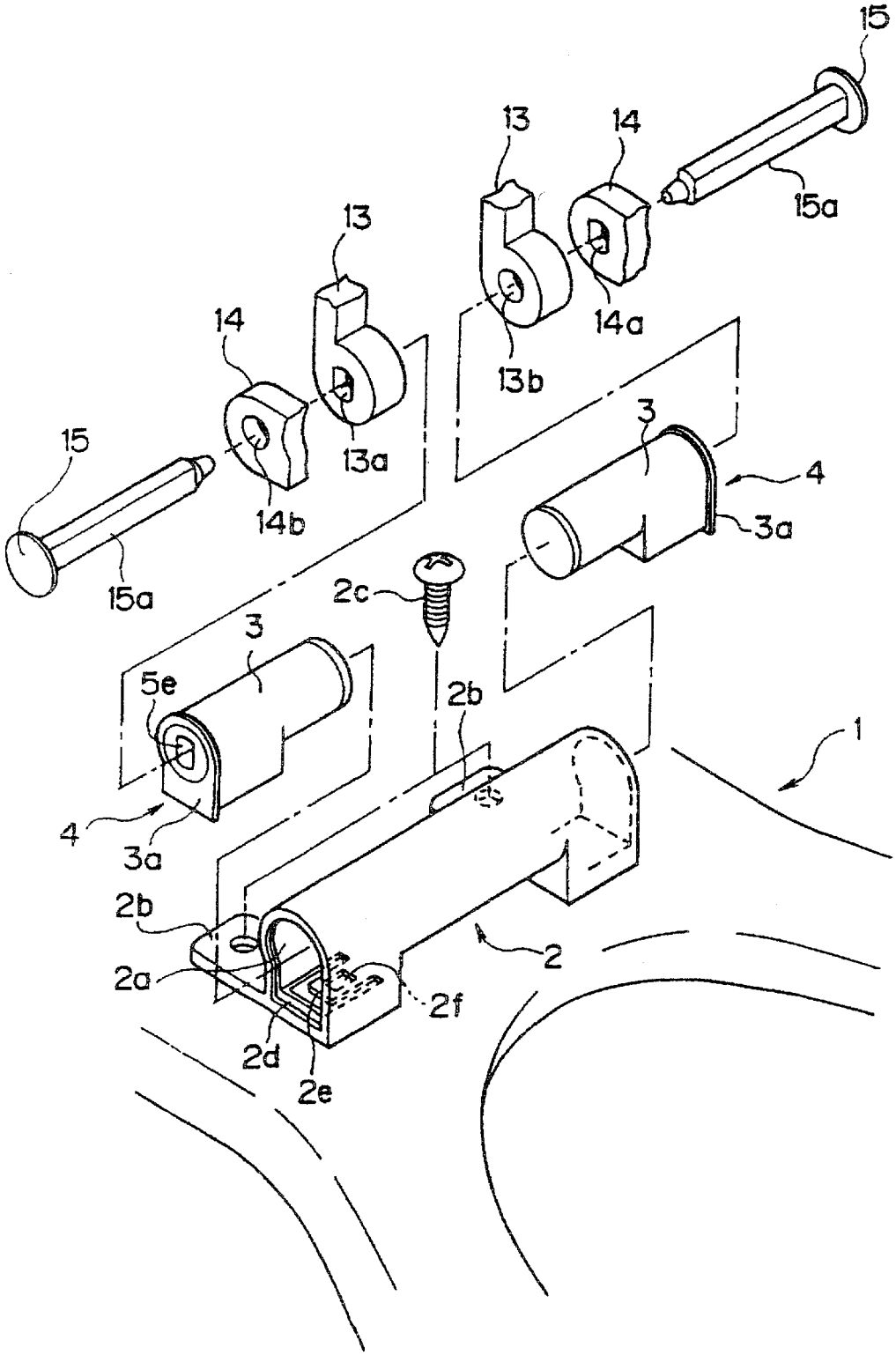
FIG. 1 is an exploded view of an example of fixtures for use to install the operative hinge according to the present invention to a toilet bowl body.

The present invention will be described hereinafter concerning an embodiment in which the operative hinge is used with a body adapted to be openable or closable such as a seat and seat lid of a toilet bowl. It should be noted, however, that the present invention is not limited to such au embodiment but it is applicable for various opening and closing structures Referring now to FIG. 1, a toilet bowl is illustrated, by way of example, of which a body is generally indicated with a reference numeral 1. For installation of the operative hinge according to the present invention to the toilet bowl body 1, there is provided on, and nearly at the center of, the rear top of the toilet bowl body 1 a cylindrical fixture 2 open at either axial end thereof (namely, it has a pair of fixing bores of which only one 2*a* is illustrated herein) and having two rearward projecting plates 2*b* formed integrally with the cylinder 2. The cylinder 2 is to be secured to the body 1 of the toilet bowl with a pair of two bolts 2*c* (only one of which is illustrated herein) which are to be driven into the bowl body 1 through a pair of holes formed in the projecting plates 2*b*, respectively.

A pair of cylindrical hinge cases 3 form a pair of hinges generally indicated with a reference numeral 4, right and left, respectively. The hinges 4, or cylindrical hinge cases 3, are designed to be inserted into the bores 2*a*, respectively, of the cylinder 2, and removably fixed inside the cylinder 2. For this fixation of each hinge case 3 or hinge 4 inside the cylinder 2, the hinge case 3 has integrally at one end thereof a flange 3*a* having a non-circular cross-section, and an engagement projection 3*b* formed integrally on the lower side thereof, as shown in FIGS. 1 to 5. The flange 3*a* is designed to fit in an engagement indent 2*d* formed in an opening end portion, tinder the bore 2*a*, of the cylinder 2. The projection 3*b* is adapted for engagement in a hole 2*f* formed in an engagement piece 2*e* provided below the bore 2*a* of the cylinder 2.

As seen in FIG. 1, the right and left binges 4 form one pair. The left hinge 4 is destined for use with the toilet seat, while the right one is for use with the sear lid. Since they are horizontally symmetrical with each other and identical in internal structure to each other, however, it should be noted that mainly the left hinge 4 will be involved in the following description for the simplicity of the explanation.

Now, the hinge 4 comprises a rotating shall 5 of which the rotation is controlled by a first controller (also called cam mechanism) A and second controller (also called damping member) B provided to the left of a partition wall 3*c* provided inside the hinge case 3 as will be best seen in FIGS. 2 to 5.

The first rotation controller A may be a cam mechanism, for example, which will be described herebelow. As best shown in FIGS. 2 to 5, the hinge case 3 receives the rotating shaft 5 so that they are axially aligned with each other. Thus, the shaft 5 is rotatable about the axis thereof as well as of the shaft 5 itself. The rotating shaft 5 consists, as counted from the left end thereof, of a base portion having an annular groove 5*a* formed circumferentially thereon and in which there is fitted a sealing member 6 such as an O-ring which will be put into contact with an inner wall 3*d* of the hinge case 3, a portion 5*b* of a large diameter on which a resilient member 7 such as a compression spring is wound, and a portion 5*c* having a reduced diameter and an elliptic cross-section and on which a rotatable cam 8 is slidably fitted. The rotating shaft 5 has also a flange 5*d* formed integrally on the large-diameter portion thereof as shown. The small-diameter portion 5*c* is born in a bearing hole 3*e* formed in the partition wall 3*c* and projecting inwardly and radially of the hinge case 3. The small-diameter portion 5*c* has fixed to an end portion thereof exposed out of the bearing hole 3*e* an engagement plate 18 with a screw 17. The engagement plate 18 is provided to prevent the rotating shaft 5 from being disengaged from the bearing hole 3*e*. The end portion exposed from the bearing hole 3*e* in the small-diameter portion 5*c* has an engagement plate 18 fixed thereon with the fixing screw 17 to prevent a disengagement, and the engagement plate 18 has also farmed on the periphery thereof a cut 18*a* which receives therein a stopper 19 projecting from the inner wall of the hinge case 3. The above-mentioned resilient member 7 is located between the flange 5*d* and rotatable sliding cam 8 to always urge the latter in one direction (rightward in the plane of the drawing).

Figure 2:
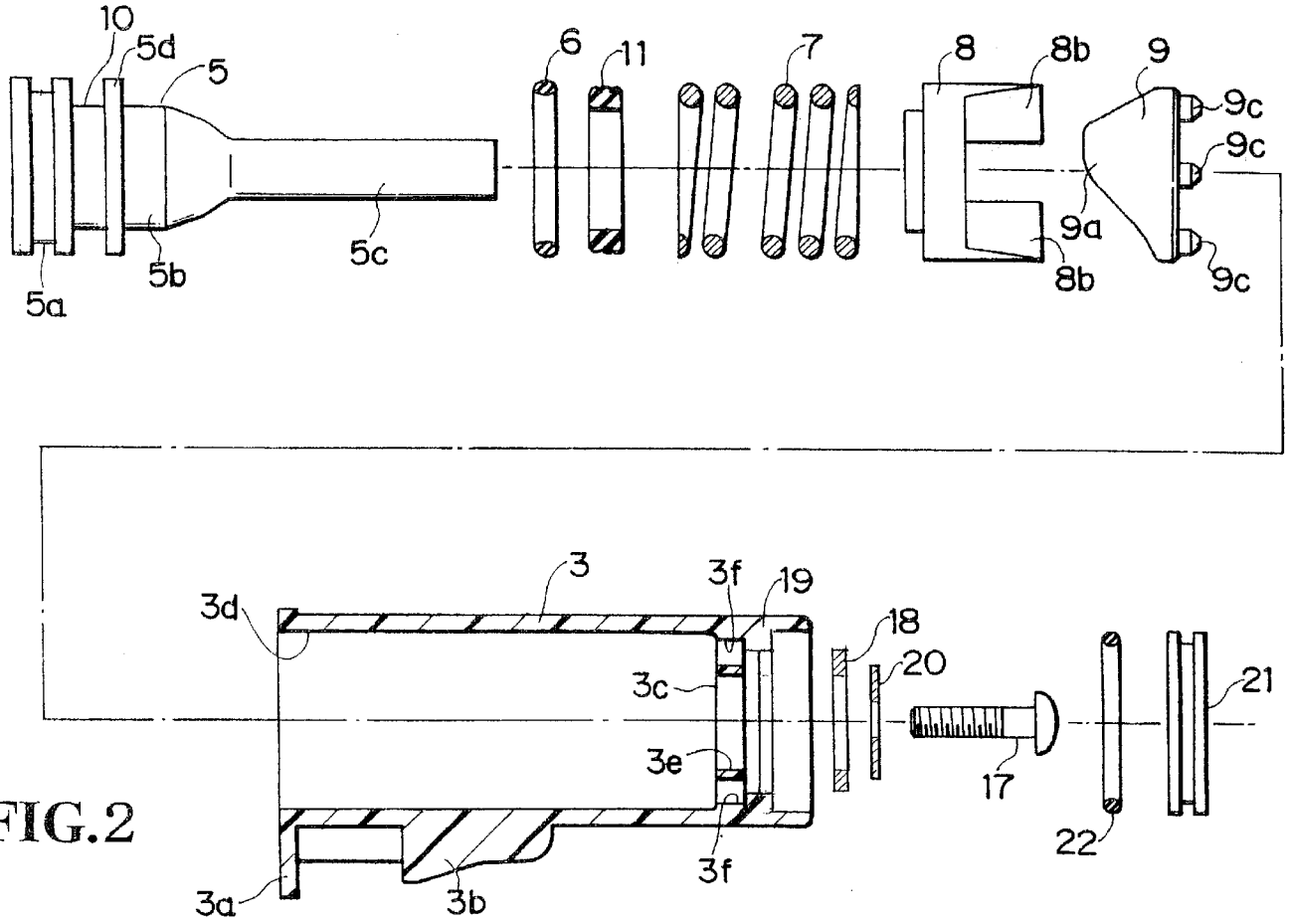
FIG. 2 is an exploded perspective view, partially in the form of an axial-sectional view, of the operative hinge of the present invention.
Figure 3:
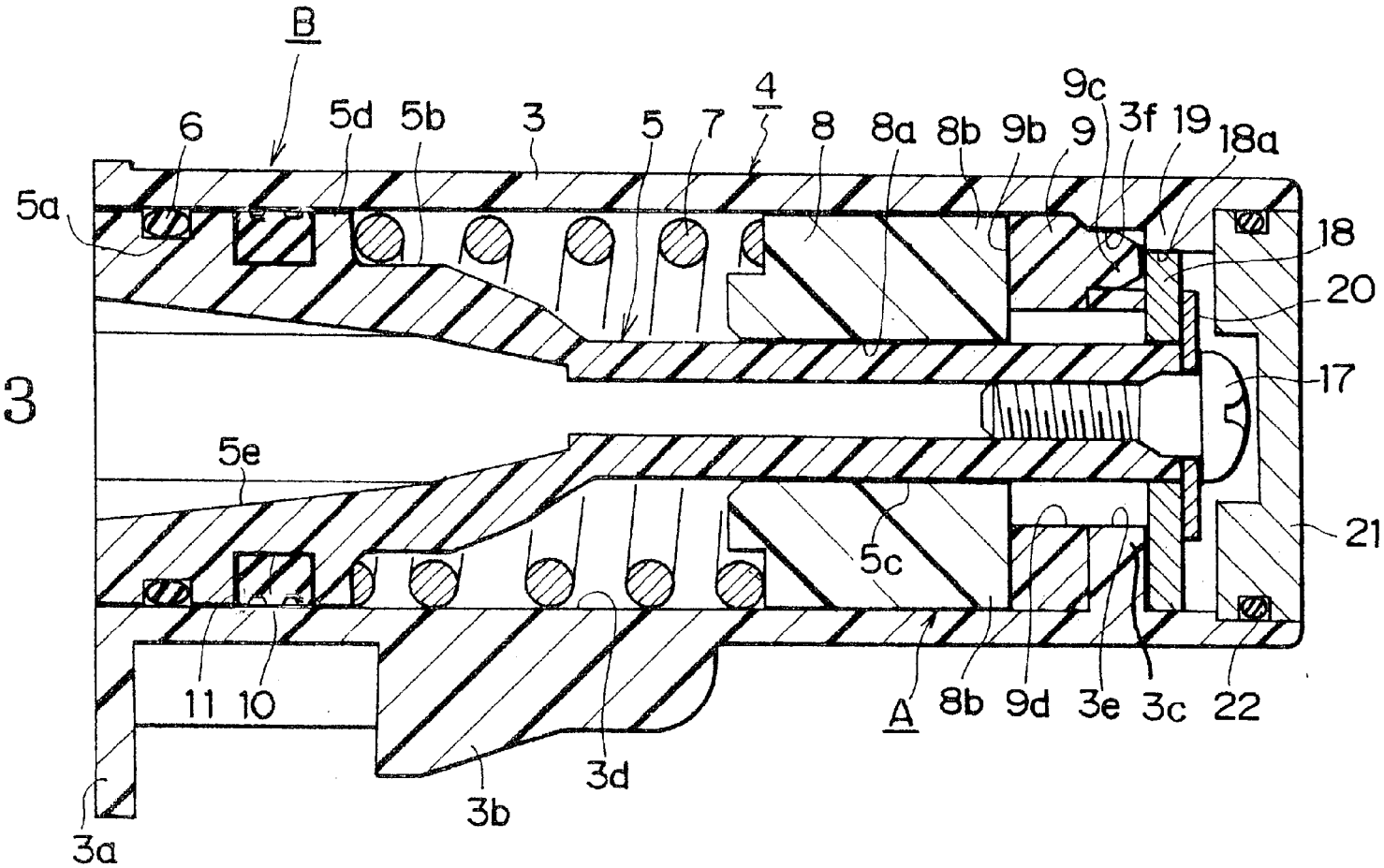
FIG. 3 is an axial-sectional view of the operative hinge of the present invention.
Figure 4:
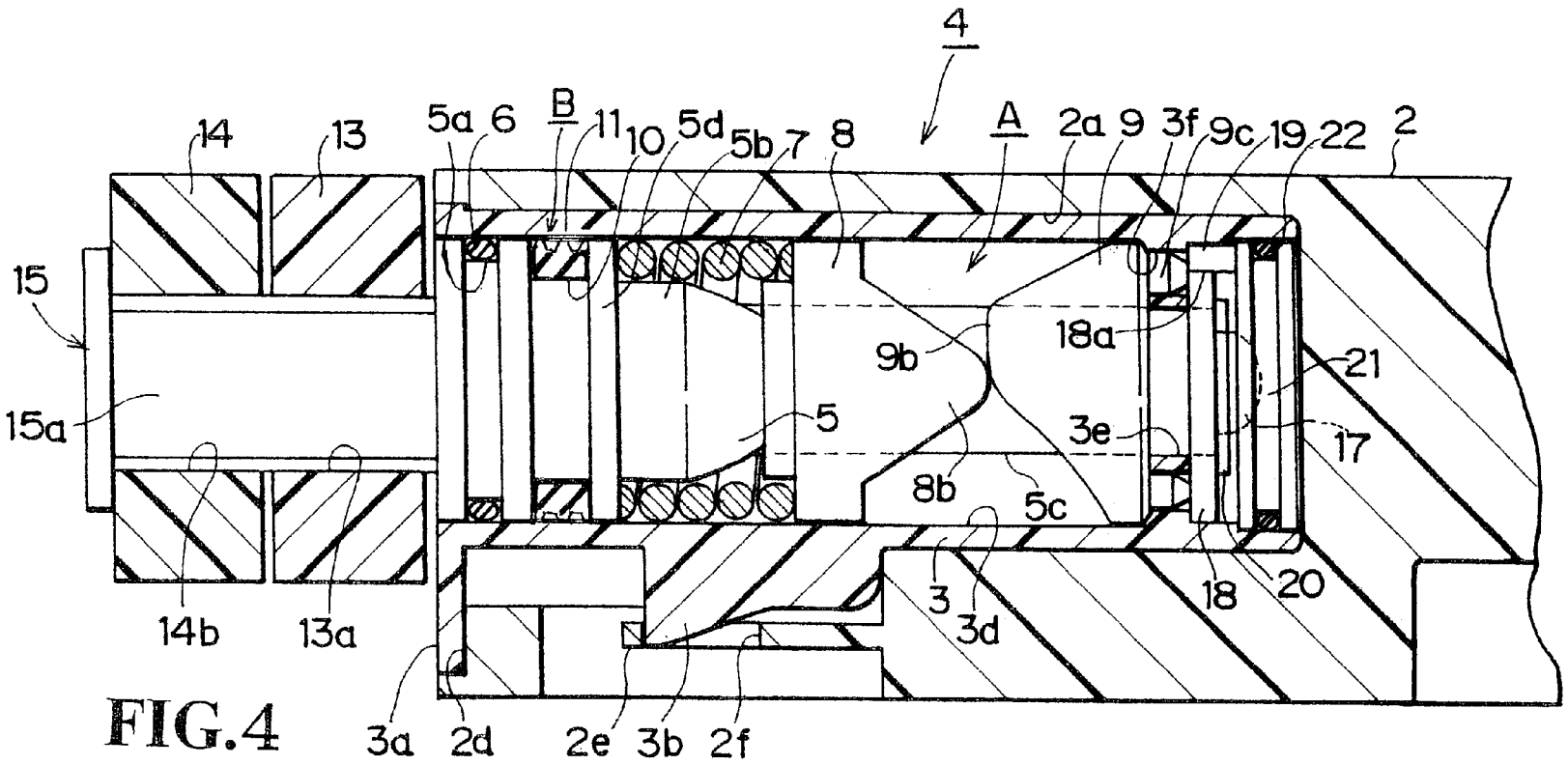
FIG. 4 explains the function of the operative binge according to the present invention.
Figure 5:
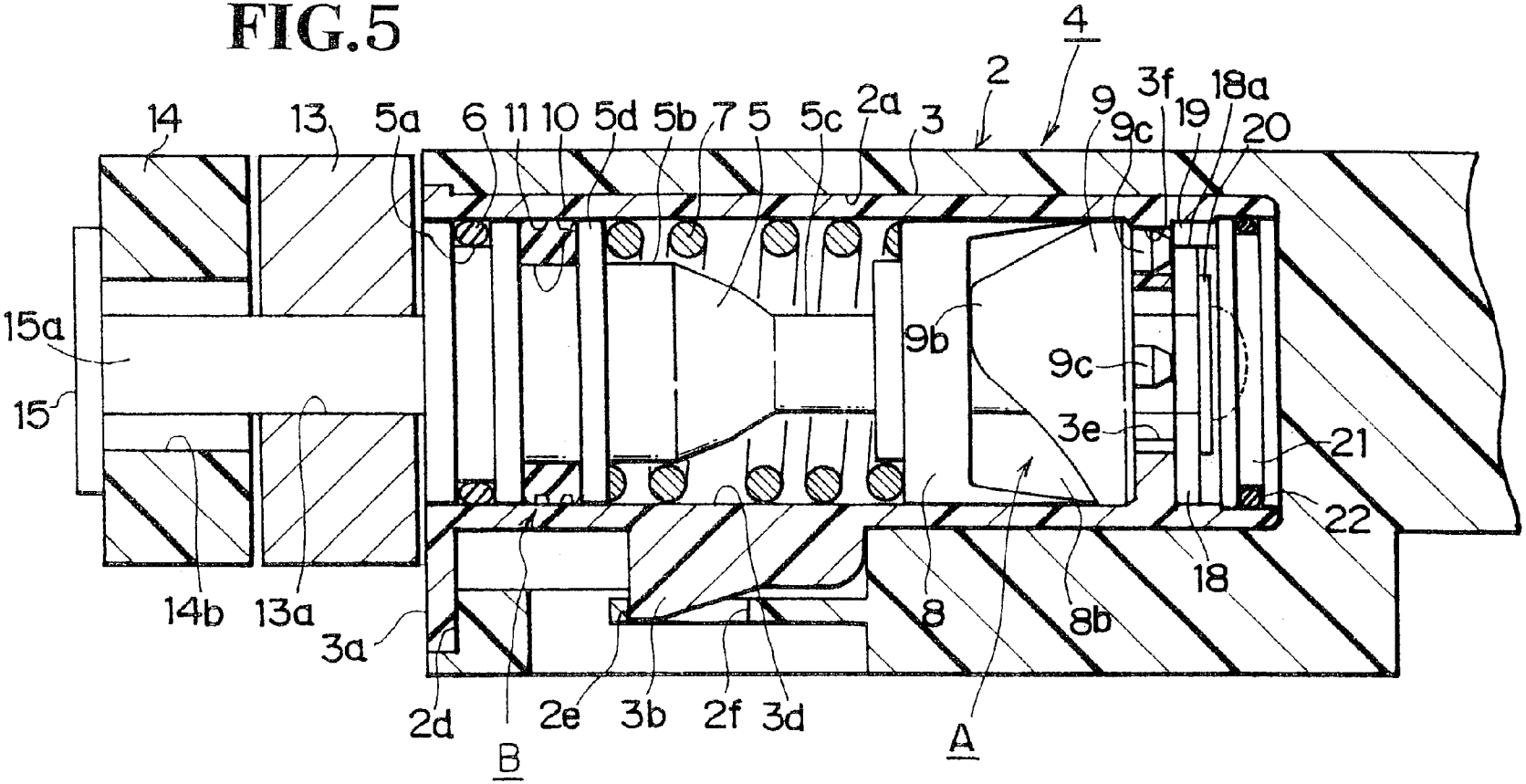
FIG. 5 is an axial-sectional view of the composite torque hinge, which is in a position when the seat has been opened to an angle of 90° from the position in FIG. 4.
Figure 9:
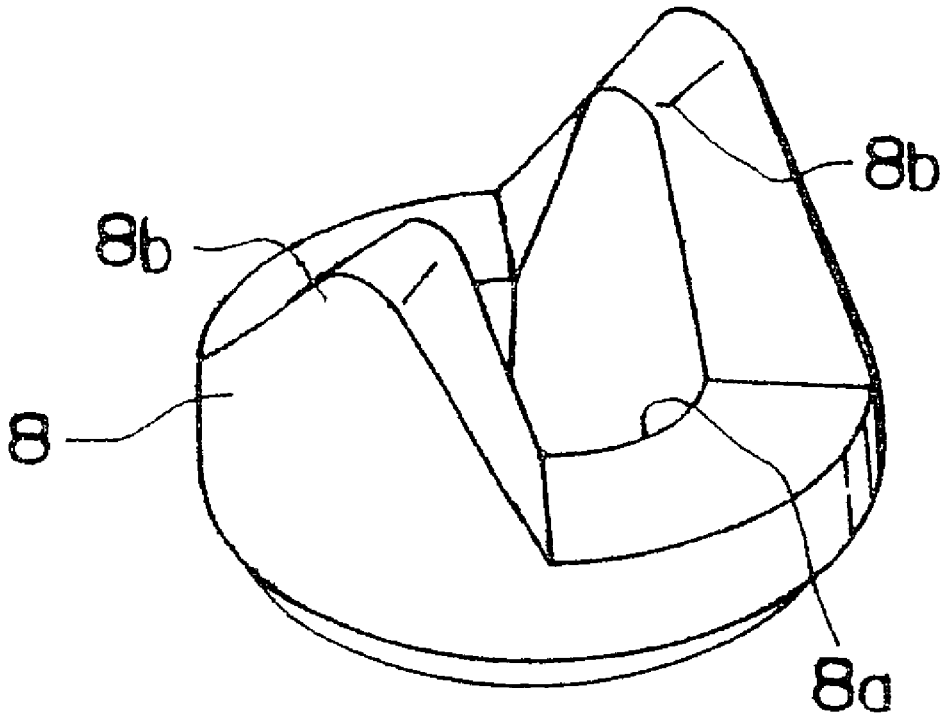
FIG. 9 is a perspective view of the rotating sliding cam.
Figure 10:
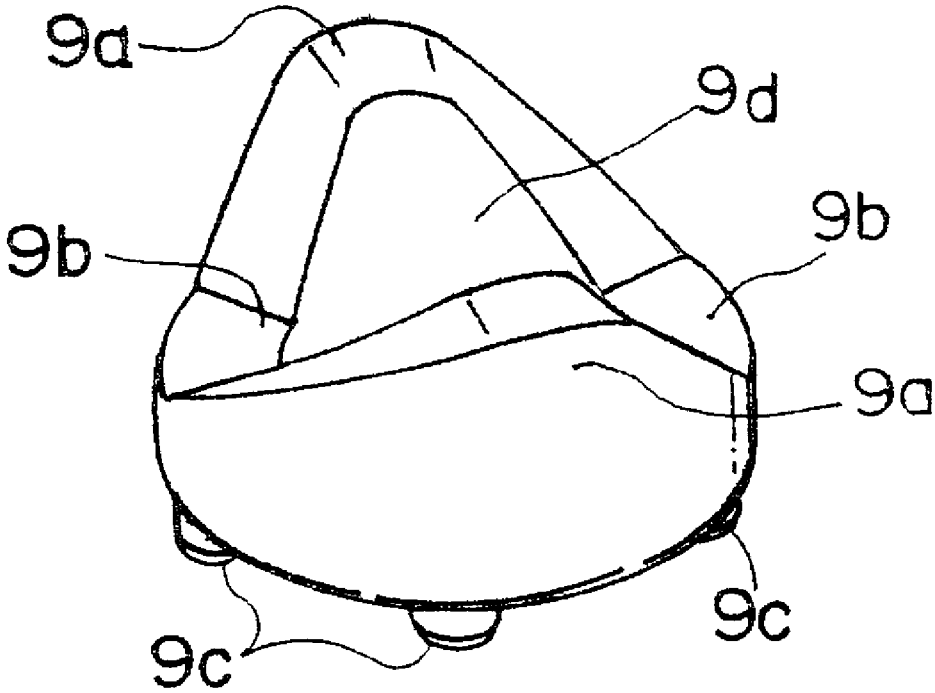
FIG. 10 is a perspective view of the stationary cam.

Also the rotatable sliding cam 8 has formed axially in the center thereof a non-circular or generally elliptic hole 8*a* as shown in FIG. 9. With the small-diameter portion 5*c* fitted in this non-circular hole 8*a*, the cam 8 can be rotated together with the shaft 5. Also, the rotatable sliding cam 8 has formed in diametrical positions along the circumference thereof two projections 8*b* extending axially as will be best seen from FIGS. 2 and 9. As shown in FIGS. 2 and 10, there is also provided inside the binge case 3 a stationary cam 9 on one side of the partition wall 3*c* facing the open end of the hinge case 3. The cam 9 has formed in diametrical positions thereof, along the circumference thereof and on one side thereof a pair of crests 9*a* and a pair of troughs 9*b*, both extending axially in one directions Further, the stationary cam 9 has formed on the other side thereof a plurality of projections 9*c* extending axially but in an opposite direction to that of the crests 9*a* and troughs 9*b*. The stationary cam 9 is fitted in an engagement hole 3*f* formed in the partition wall 3*c* as shown in FIGS. 3 to 5. The stationary cam 9 has a circular hole 9*d* formed axially in the center thereof The small-diameter portion 5*c* of the rotating shaft 5 is fitted rotatably through this hole 9*d* of the stationary cam 9. Thus, when all are set inside the hinge case 3, the rotatable sliding cam 8 and stationary cam 9 are placed in a vis-a-vis relationship, and in contact, with each other, with the projections 8*b* of the cam 8 facing the crests 9*a* and troughs 9*b* of the cam 9.

Figure 6:
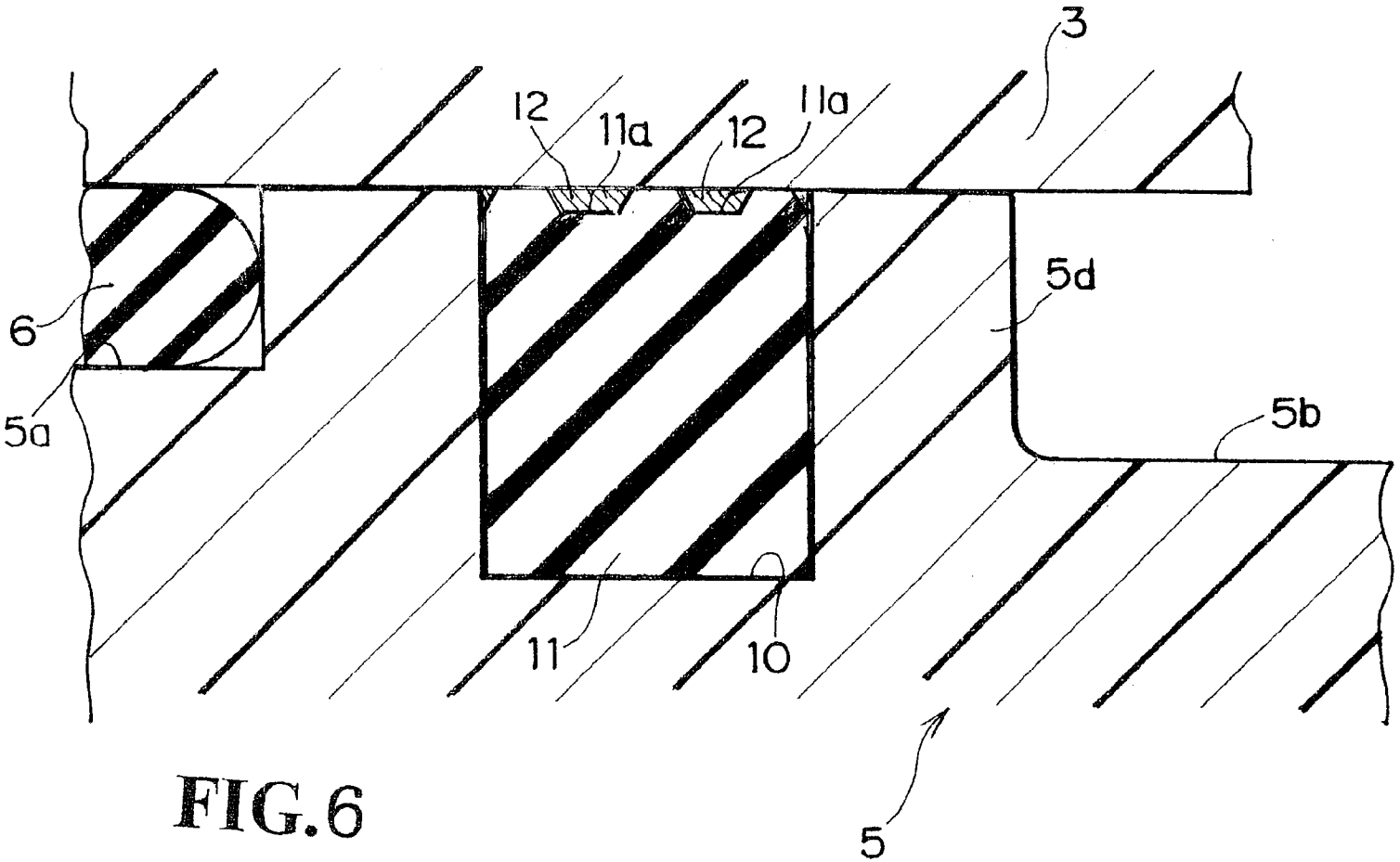
FIG. 6 is a fragmentary sectional view, enlarged in scale, of the damping member.
Figure 7:
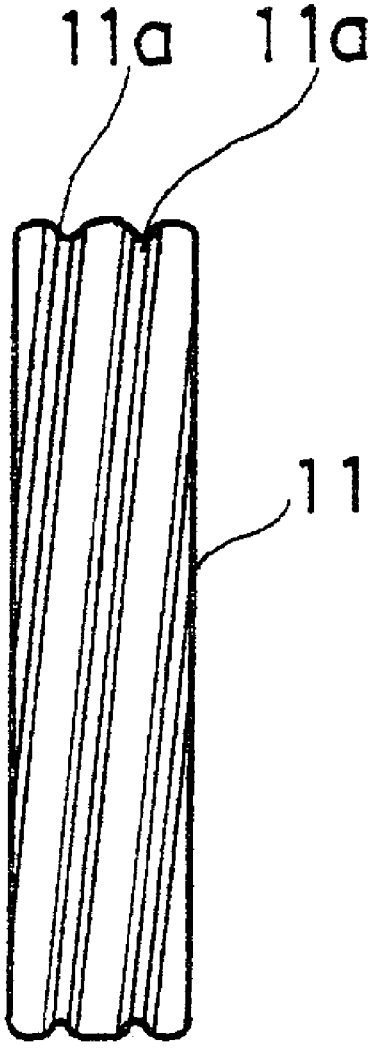
FIG. 7 is a front view of the rubber ring included in the present invention.
Figure 8:
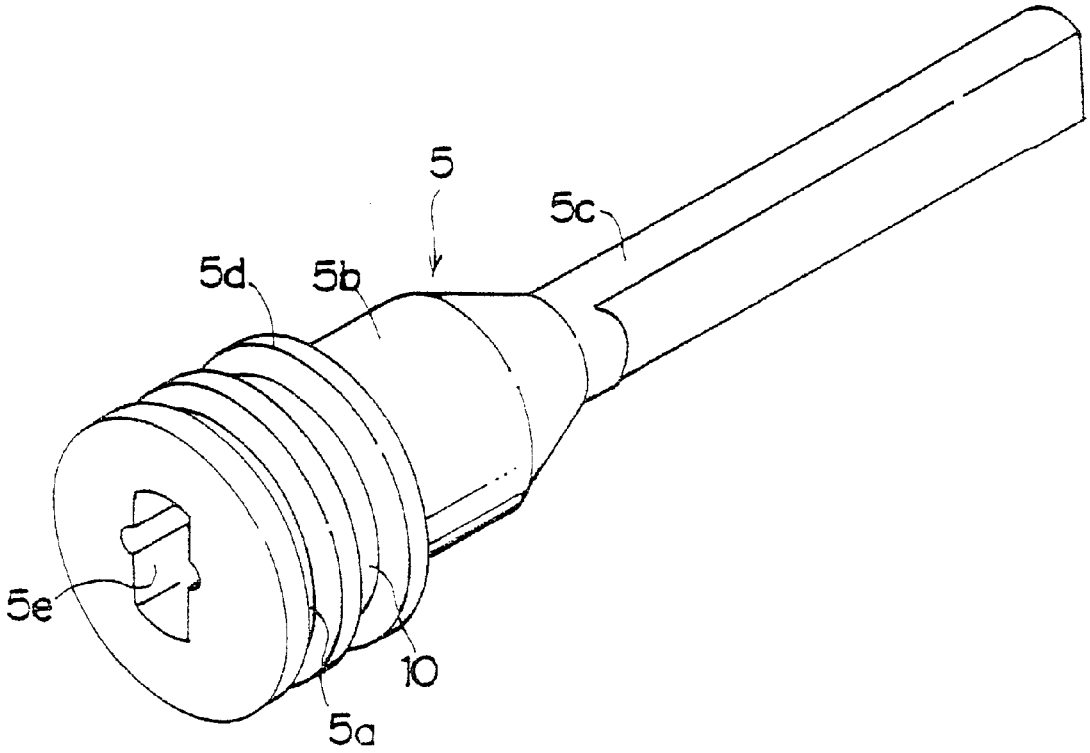
FIG. 8 is a perspective view of the rotating shaft.

Next, the second rotation controller B will be described herebelow. This controller B may be a damper, for example. As seen from FIGS. 3 to 7, a circumferential recess 10 is formed on the circumferential surface of the large-diameter portion 5*b* of the rotating shaft 5, and a rubber ring 11 is fitted in the circumferential recess 10 and urged to the inner wall of the hinge case 3. As shown in FIG. 6, a viscous oil 12 such as grease silicone oil is provided, between the circumference of the rubber ring 11 and inner wall of the hinge case 3. The rubber ring 11 is made of a rubber, for example, but it may be a one made of a suitable synthetic resin. As seen from FIGS. 6 and 7, the rubber ring 11 has formed on the periphery thereof a plurality of recesses 11*a* to receive and retain the viscous oil therein As best seen from FIG. 3, the rotating shaft 5 has formed in the large-diameter portion thereof at an end portion thereof exposed out of the hinge case 3 a non-circular hole 5*e* extending axially and inwardly of the end face of the shaft 5. The non-circular hole 5*e* has force-fitted therein a coupling pin 15 which supports a toilet seat base 13 and a seat lid base 14 as shown in FIGS. 1, 4 and 5. The coupling pin 15 has a shaft portion 15*a* having a non-circular or generally elliptic cross-section corresponding to that of the hole 5*e*. The shaft portion 15*a* is first penetrated through a circular hole 14*b* formed in the lid base 14, then through a hole 13*a* formed in the seat base 13, and further into the non-circular hole 5*e* of the shaft 5. Namely, the lid base 14 is pivoted to the shaft portion 15*a*. Thus, the coupling pin 15 is rotatable with the seat base 13, and not with the rotating shaft 5. The lid base 14, namely, the seat lid, is freely pivotable about the shaft portion 15*a* of the coupling pin 15 because of the circular hole 14*b* in the lid base 14. In effect, when the seat is opened or closed, this right-side rotation controller 4 allows the shaft 5 to be rotated about the coupling pin 15. On the contrary, when the seat lid is operated, it is just only supported on the pin shaft portion 15*a* and the shaft 5 will not be rotated correspondingly. In Figures, the reference numeral 20 indicates a washer 20, 21 indicates a plug which closes an end of the hinge case 3 opposite to the outer end, and 22 indicates a sealing member such as an O-ring, for example.

FIG. 1 also shows the right-side hinge case 3 or hinge 4 in addition to the left-side binge case 3 or hinge 4 having been described above. The right-side hinge case 3 or hinge 4 will be briefly described herebelow. As in the left-side hinge 4 having been described in the foregoing, the coupling pin 15 has a shaft portion 15*a* having a same shape as the left-side one. The shaft 15*a* is introduced in the non-circular hole 5*e* in the rotating shaft 5. However, the lid base 14 has formed therein a non-circular hole 14*a*, and the seat base 13 has a circular hole 13 formed therein. As mentioned above, the shaft portion 15*a* is to be first penetrated through the non-circular hole 14*a* in the lid base 14 and then into the circular hole 13*b* in the seat base 13. Thus, the seat base 13 is pivotable about the shaft portion 15*a* of the right-side coupling pin 15. Because of the non-circular hole 14*a* in the lid base 14, the coupling pin 15 is rotatable with the lid base 14. That is, when the seat is operated, its base 13 is just only supported on the coupling pin 15 and the shaft 5 will not be rotated correspondingly. Therefore, the left-side hinge 4 in FIG. 1 is destined for controlling the rotation of the toilet seat while the right-side one 4 is for use with the seat lid.

The operative hinge constructed as in the foregoing according to the present invention functions as will be described herebelow:

With the seat 13*c* in the closed position, the rotatable sliding cam 8 of the cam mechanism or the first rotation controller A shown in FIG. 4 is in contact, at the projections 8*b* thereof, with the crests 9*a* of the stationary cam 9, and the resilient member 7 is fully compressed. On the other hand, the rubber ring 11 as a damping member in the second rotation controller B is in slight contact with the inner wall of the hinge case 3. When the toilet seat 13*c* is opened from this position, the rotating shaft 5 will be rotated against the action of the damping member by means of the coupling pin 15 by which the seat base 13 is connected to the rotating shaft 5, and the projections 8*b* of the rotatable sliding cam 8 rotating in a same direction as the shaft 5 will slide in the direction of the stationary cam 9 while going down from the crest 9*a* into the trough 9*b*.

Thus, the rotating shaft 5 is allowed to smoothly rotate to open the seat 16*c* up to an angle of 90°.

When closing the seat 13*c* once opened, the first rotation controller A will reversely follow the above opening procedure. In this case, however, the projections 8*b* of the rotatable sliding cam 8 will start moving at an opened angle of about 40° and slide on the stationary cam 9 from the trough 9*b* of the cam 9 to the crest 9*a* against the resilience of the member 7. At this time, a resistance will take place to cause a reverse torque which will cancel the angular moment of the seat 13*c*, thereby preventing the seat 13*c* from being abruptly closed. On the other hand, the rubber ring 11 as a damping member in the second rotation controller B, abutting the inner wall of the hinge case 3, and the viscosity of the oil 12 applied between the periphery of the rubber ring 11 and the inner wall of the hinge case 3 the robber ring 11 abuts, will provide a damping action tinder which the torque is controlled, whereby the seat 13*c* can be closed softly even when the seat 13*c* is released by taking off the hand from it.

As having been described above, when closing the seat 13*c*, the reverse torque of the cam mechanism of the first rotation controller A and the damping action of the damping member in the second rotation controller B, will effectively allow the seat 13*c* to be closed calmly or gently, not abruptly.

Figure 11:
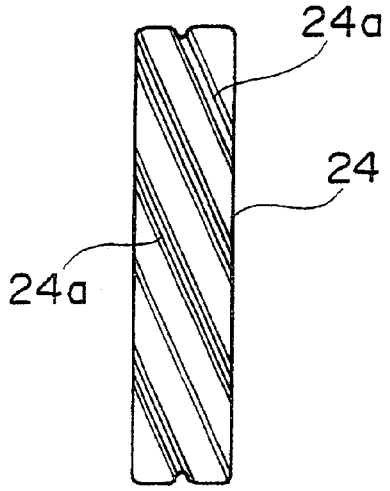
FIG. 11 is a front view of a variant of the rubber ring included in the present invention.
Figure 12:
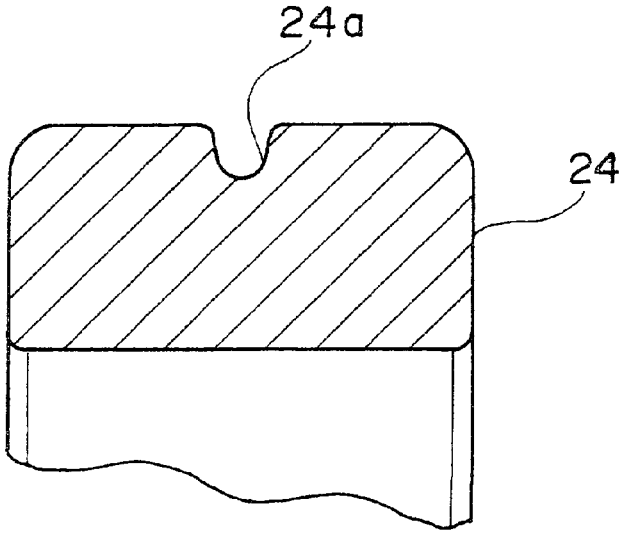
FIG. 12 is a sectional view, enlarged in scale, of the rubber ring in FIG. 11.

FIGS. 11 and 12 show together a variant of the rubber ring included in the present. As shown, a rubber ring 24 has formed on the whole circumferential surface thereof a plurality of short, regularly spaced recesses 24*a* extending obliquely from the left lateral side to right lateral side of the rubber ring 24 to retain tile viscous oil 12.

Figure 13:
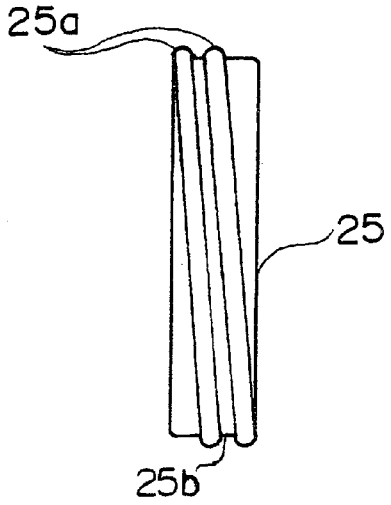
FIG. 13 is a front view of another variant of the rubber ling included in the present invention.
Figure 14:
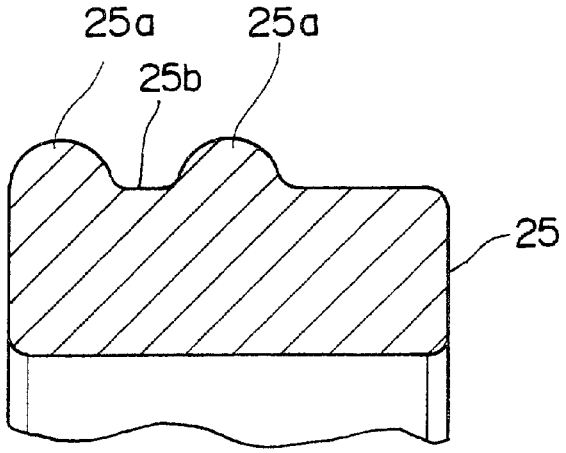
FIG. 14 is a sectional view, enlarged in scale, of the rubber ring in FIG. 13.

FIGS. 13 and 14 show together another variant of the rubber ring included in the present invention. As shown, a rubber ring 25 has formed on the circumferential surface thereof a plurality of spiral projections 25*a* of which the cross section is round and which define a plurality of recesses 25*b* to retain the viscous oil 12.

Figure 15:
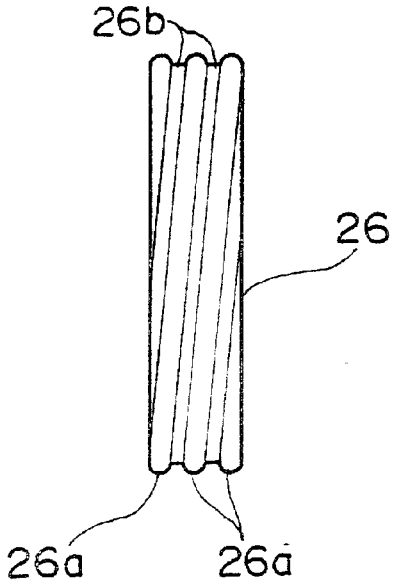
FIG. 15 is a front view of a still another variant of the rubber ring included in the present invention.
Figure 16:
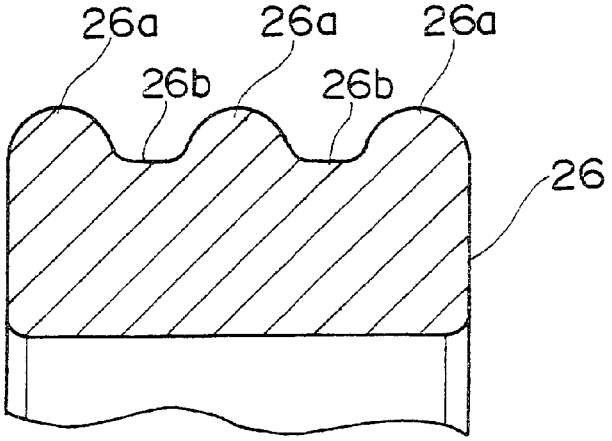
FIG. 16 is a sectional view, enlarged in scale, of the rubber ring in FIG. 15.

FIGS. 15 and 16 show together a still another variant of the rubber ring included in the present invention. As shown, a rubber ring 26 has formed on the circumferential surface thereof a plurality of projections 26*a* of which the cross section is round and counting the number of projections in the variant shown in FIGS. 13 and 14 plus one to form a plurality of recesses 26*b* which retains the viscous oil 12.

Figure 17:
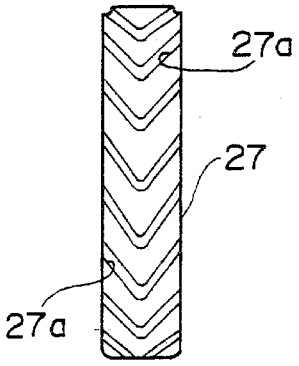
FIG. 17 is a front view of a yet another variant of the rubber ring included in the present invention.
Figure 18:
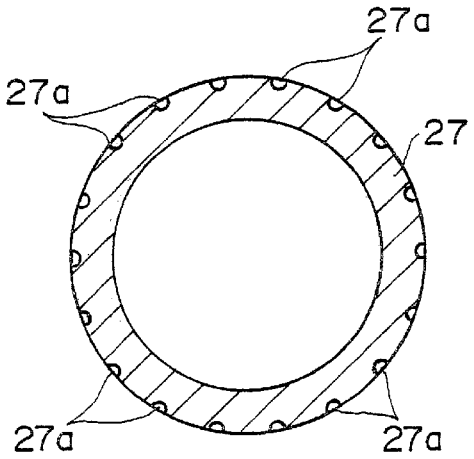
FIG. 18 is a cross-sectional view of the rubber ring in FIG. 17.
Figure 19:
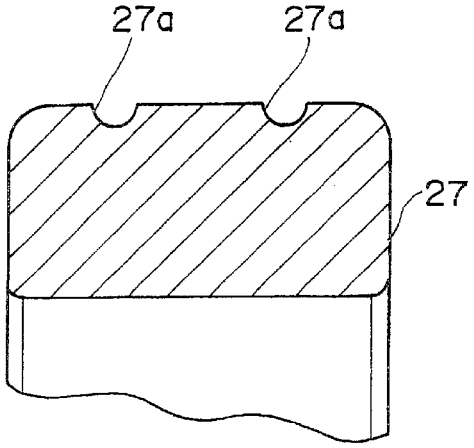
FIG. 19 is a sectional view, enlarged in scale, of the rubber ring in FIG. 17

FIGS. 17 to 19 show together a yet another variant of the rubber ring included in the present invention. As shown, a rubber ring 27 has formed on the circumferential surface thereof a plurality of regularly spaced recesses 27*a* each having two portions 27*a* extending from both lateral sides of the rubber ring 27 towards the center of the later to form a V shape to retain the viscous oil 12.

Figure 20:
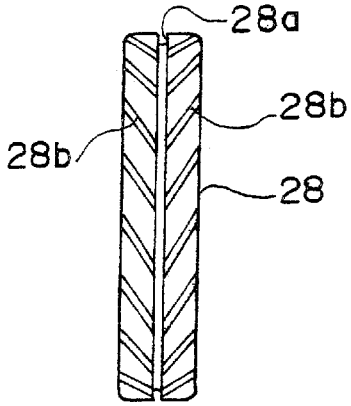
FIG. 20 is a front view of a still yet another variant of the rubber ring included in the present invention.
Figure 21:
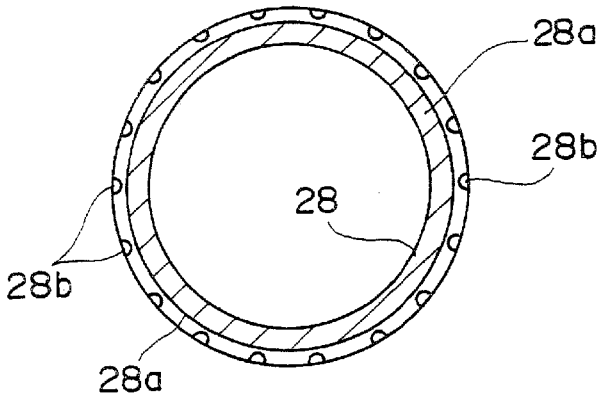
FIG. 21 is a cross-sectional view of the rubber ring in FIG. 20.
Figure 22:
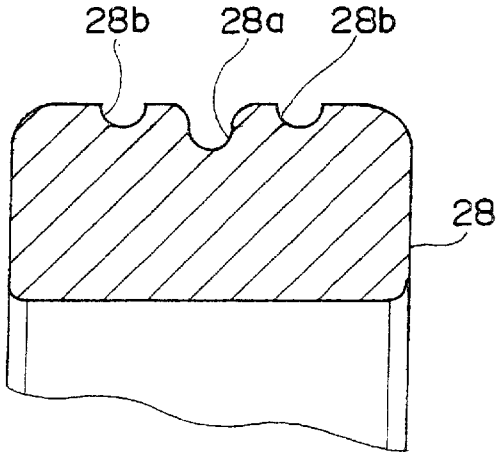
FIG. 22 is a sectional view, enlarged in scale, of the rubber ring in FIG. 20

FIGS. 20 to 22 show together a still yet another variant of the rubber ring included in the present invention. As shown, a rubber ring 28 has formed on the circumferential surface thereof a central, deep annular recess 28*a* to retain the viscous oil 12 and a plurality of regularly spaced, somewhat shallow recesses 28*b* each having two portions extending from both lateral sides of the rubber ring 28 towards the central recess 28*a* to form a V shape to retain the viscous oil 12.

Figure 23:
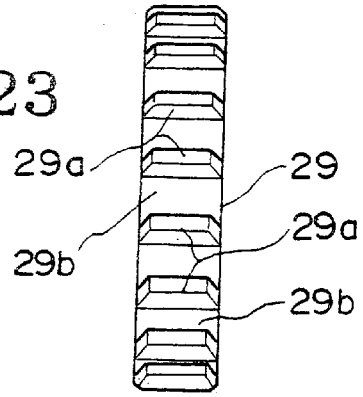
FIG. 23 is a front view of a yet further another variant of the rubber ring included in the present invention.
Figure 24:
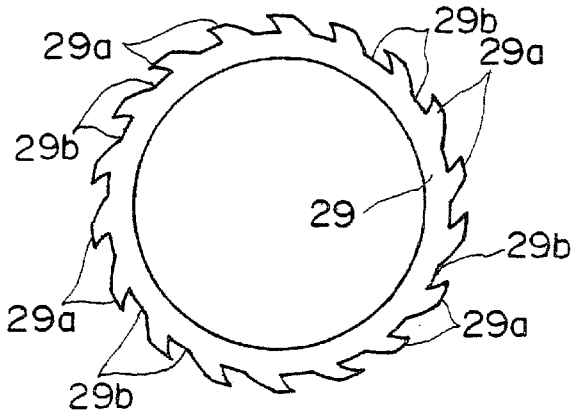
FIG. 24 is a cross-sectional view of the rubber ring in FIG. 23.
Figure 25:
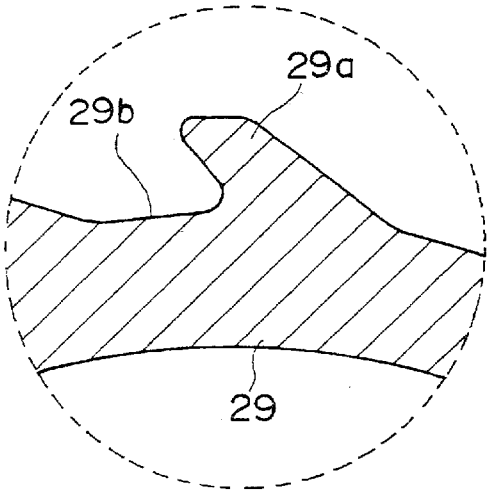
FIG. 25 is a sectional view, enlarged in scale, of the rubber ring in FIG. 23.

FIGS. 23 to 25 show together a yet further another variant of the rubber ring included in the present invention. As shown, a rubber ring 29 has formed on the whole circumferential surface thereof a plurality of regularly spaced projections 29*a* having a sawtooth-like cross section to form a plurality of recesses 29*b* which retains the viscous oil 12.

Figure 26:
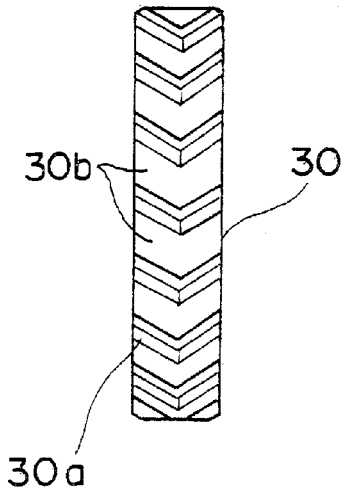
FIG. 26 is a front view of a still yet further another variant of the rubber ring included in the present invention.
Figure 27:
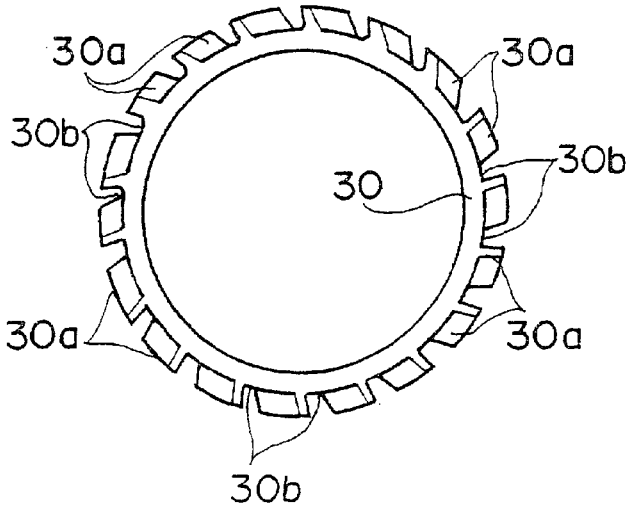
FIG. 27 is a cross-sectional view of the rubber ring in FIG. 26.

FIGS. 26 and 27 show together a still yet further another variant of the rubber ring including in the present invention. As shown, a rubber ring 30 has formed on the whole circumferential surface thereof a plurality of regularly spaced V-shaped projections 30*a* laid in a same direction to form recesses 30*b* which retains the viscous oil 12

With the hinge according to the present invention, having the cam mechanism A and damping member B optimally combined, when the seat 13*c* is closed to an angle of 80°, and then released with some force applied thereto, it will be closed to an angle of about 40° at a relatively high speed under a weak cam torque and damping action. This operation will take about 2 sec. Thereafter, the crests 8*b* of the rotatable sliding cam 8 of the cam mechanism will climb the ascending slopes of the troughs 9*b* toward the crests 9*a* of the cam 9 against the resilience of the member 7. Therefore, the seat 13*c* will be closed slowly to an angle of about 10°, and then more slowly to an angle of 0°. A time of about 5 sec is required for this full closing of the seat 13*c*.

Thus, a composite torque action, derived from the cam torque created by the cam mechanism A and the damping action of the damping member B, permits to adjust the operating time of the seat 13*c* being opened or closed and elaborately control the movement of the seat 13*c* in each of the operating steps for the user to be noticed of the timely seat In the foregoing, mainly the left-side hinge 4 for the seat 13*c* has been described as to the function thereof. The right-side hinge 4 is used to open and close the seat lid from a closed position. However, since the seat lid is not frequently operated in comparison with the seat 13*c*, it is not so much required to elaborately control the movement of the seat lid for the user to be noticed of the seat lid operations. Therefore, for the seat lid hinge, the stationary cam may be designed to have crests and troughs of more simplified shapes than those of the stationary cam in the seat hinge. Since an angular moment taking place in this seat lid binge is basically the same as a one in the seat hinge, however, the stationary cam in the seat lid hinge may be of a same structure as that in the seat hinge except for the shape of the crests and troughs. No further description will be made of the hinge 4 for the seat lid.

What is claimed is:

1. An operative hinge for use with an opening/closing body, comprising:

a hinge case to be installed to a toilet bowl body for operating the opening/closing body;

a shaft provided rotatably within the binge case to support the opening/closing body;

a stationary cam fixed within the hinge case and having formed therein a central through-hole through which the rotating shaft is axially penetrated;

a cam provided within the hinge case and having formed therein a central through-hole through which the rotating shaft is axially penetrated to be slidable on, and rotatable with, the rotating shaft; and a resilient means for urging the rotatable sliding cam toward the stationary cam, the hinge further comprising, to control the rotation or the rotating shaft:

a damping means consisting of:

a rubber ring fitted on the rotating shaft and interposed between the outer surface of the rotating shaft and the inner wall of the hinge case; and a viscous oil applied between the outer surface of the rubber ring and inner wall of the hinge case;

the rubber ring having spiral recesses formed on the outer surface thereof.

2. An operative hinge for use with an opening/closing body, comprising:

a fixing cylinder for installation to a toilet bowl body;

a pair of hinge cases to be installed removably to the right and left, respectively, of the fixing cylinder;

a rotating shaft provided rotatably within each hinge case to support the opening/closing body, each rotating shaft having a non-circular hole;

a seat lid and seat of the toilet bowl fixed to each rotating shaft by coupling pins tightly inserted into each non-circular hole of said each rotating shaft;

a stationary cam fixed within the hinge case and having formed therein a central through-hole through which the rotating shaft is axially penetrated;

a cam provided within the hinge case and having formed therein a central through-hole through which the rotating shaft is axially penetrated to be slidable on, and rotatable with, the rotating shaft; and a resilient means for urging the rotatable sliding cam toward the stationary cam, the hinge further comprising, to control the rotation of the rotating shaft;

a damping means consisting of:

a rubber ring fitted on the rotating shaft and interposed between the outer surface of the rotating shaft and the inner wall of the hinge case; and a viscous oil applied between the outer surface of the rubber ring and inner wall of the hinge case;

the rubber ring having recesses formed on the outer surface thereof.

3. An operative hinge for use with an opening/closing body, comprising:

a fixing cylindrical body for installation a toilet bowl body;

a pair of hinge cases to be installed removably to the right and left, respectively, of the fixing cylindrical body;

a shaft provided rotatably within each hinge case to support the opening/closing body, each rotating shaft having a non-circular hole;

a seat lid and seat of the toilet bowl fixed to each rotating shaft by coupling pins tightly inserted into each non-circular hole of said each rotating shaft;

a stationary cam fixed within the hinge case and having formed therein a central through-hole through which the rotating shaft is axially penetrated;

a cam provided within the hinge case and having formed therein a central through-hole through which the rotating shaft is axially penetrated to be slidable on, and rotatable with, the rotating shaft; and a resilient means for urging the rotatable sliding cam toward the stationary cam, wherein, the seat lid has a pair of seat lid bases, one of the seat lid bases being engaged with one of the coupling pins, and the other of the seat lid bases rotatable mounted on the other of the coupling pins; and the seat having a pair of seat bases, one of the seat bases being rotatable mounted on said one of the coupling pins, and the other of the seat bases engaged with said other of the coupling pins;

the hinge further comprising, to control the rotation or the rotating shaft;

a damping means consisting of:

a rubber ring fitted on the rotating shaft and interposed between the outer surface of the rotating shaft and the inner wall of the hinge case; and a viscous oil applied between the outer surface of the rubber ring and inner wall of the hinge case;

the rubber ring having recesses formed on the outer surface thereof.

4. The operative hinge as set forth in any of claims 1 to 3, wherein the rubber ring has formed on the whole circumferential surface thereof a plurality of short, appropriately spaced recesses extending obliquely from a left lateral side to a right lateral side of the rubber ring.

5. The operative hinge as set forth in any one of claims 1 to 3, wherein the rubber ring has formed on the circumferential surface thereof a plurality of spiral projections each having a round cross section.

6. The operative hinge as set forth in any one of claims 1 to 3, wherein the rubber ring has formed on the circumferential surface thereof a plurality of appropriately spaced recesses each having two portions extending from both the lateral sides of the rubber ring towards the center of the latter to form a V shape, the V-shaped recesses being directed in a same direction along the whole circumference of the rubber ring.

7. The operative hinge as set forth in any one of claims 1 to 3, wherein the rubber ring has formed on the circumferential surface thereon a central circumferential recess and a plurality of appropriately spaced recesses each having two portions extending from both the lateral sides of the rubber ring towards the central circumferential recess to form a V shape, the V-shaped recesses being directed in a same direction along the whole circumference of the rubber ring.

8. The operative hinge as set forth in any one of claims 1 to 3, wherein the rubber ring has formed on the circumferential surface thereof a plurality of projections each having a sawtooth-shaped cross section.

9. The operative hinge as set forth in any one of claims 1 to 3, wherein the rubber ring has formed on the circumferential surface thereof a plurality of projections each having two portions extending from both the lateral sides of the rubber ring towards the center of the latter to form a V shape.

* * * * *